US008020362B2

(12) United States Patent
Kroetch

(10) Patent No.: US 8,020,362 B2
(45) Date of Patent: Sep. 20, 2011

(54) ADJUSTABLE SADDLE

(76) Inventor: Danny Kroetch, Calgary (CA)

( * ) Notice: Subject to any disclaimer, the term of this patent is extended or adjusted under 35 U.S.C. 154(b) by 5 days.

(21) Appl. No.: 12/392,366

(22) Filed: Feb. 25, 2009

(65) Prior Publication Data

US 2009/0217629 A1 Sep. 3, 2009

(30) Foreign Application Priority Data

Feb. 28, 2008 (CA) ..... 2624098

(51) Int. Cl.
*B68C 1/04* (2006.01)

(52) U.S. Cl. ..... 54/44.3

(58) Field of Classification Search ..... 54/44.3, 54/40.1, 44.1
See application file for complete search history.

(56) References Cited

U.S. PATENT DOCUMENTS 1,155,465 A 10/1915 Beal
3,343,338 A 9/1967 Stübben
5,343,674 A 9/1994 Brown
5,383,328 A * 1/1995 Brown ..... 54/44.3
5,435,116 A 7/1995 Brown

FOREIGN PATENT DOCUMENTS

DE 3902305 A1 * 8/1990
EP 764607 A1 * 3/1997
GB 2239158 A * 6/1991

* cited by examiner

*Primary Examiner* — Son T Nguyen
(74) *Attorney, Agent, or Firm* — Vedder Price PC; Ajay A. Jagtiani

(57) ABSTRACT

An adjustable saddle for a horse or other animal includes a pommel with substantially opposed lower ends, a seat member connected to the pommel and a pair of substantially opposed gripping members comprising flexible panels configured to contact the flanks of the animal. The panels have rearward portions fastened to the seat member and forward portions which are substantially free of contact with the seat member. An adjustment means connects at least one of the forward portions to the pommel. The adjustment means is configured to cause the panels to flex between a retracted position where the gripping members are relatively widely spaced and a gripping position where the gripping members are relatively closely spaced together. The gripping position provides gripping action against the upper body of the animal when the saddle is in use.

15 Claims, 4 Drawing Sheets

ADJUSTABLE SADDLE

CROSS REFERENCE TO RELATED APPLICATIONS

This application claims the benefit of priority to Canadian patent application No. 2,624,098 filed Feb. 28, 2008.

FIELD OF THE INVENTION

This invention relates to the field of saddles for horses and other animals and in particular to a saddle that may be adjusted to improve the fit of the saddle on the back of a horse or other animal.

BACKGROUND OF THE INVENTION

Attempts have been made in saddle designs to comfortably fit varying shapes and sizes of horses without either causing discomfort to the horse or elaborate adjustment of the saddle. It is known that a horse may outgrow a given saddle and that one saddle fitting one particular horse may not necessarily be comfortably fitted to another horse.

Attempts have been made in the prior art to produce a saddle tree design which accommodates different horses. Examples include saddle trees made of flexible materials, in an attempt to provide a single saddle which may comfortably fit a range of horse sizes. For example, U.S. Pat. Nos. 5,343,674 and 5,435,116 disclose saddle trees having a pair of laterally spaced apart flexible synthetic elongate members connected by a spanning member and a seat element.

In another example U.S. Pat. No. 5,884,459 discloses a saddle tree having a pair of elongate bearing members connected to the saddle tree substantially along its entire length by pivotable mounting means. The elongate bearing members are removable and interchangeable to accommodate different sizes of horses.

SUMMARY OF THE INVENTION

It is an object of this invention to provide a conveniently adjustable saddle that can be adjusted by a rider to fit a range of horse sizes and to permit the wither muscles and shoulders of the horse to move with freedom, thereby reducing unfavorable pressure points and stabilizing the saddle from front to back and side to side, assuring comfort to the horse.

It is a further object to provide a saddle which may be adjusted to properly fit the body of a range of horse sizes without disassembly of the component parts thereof, and in a further aspect, wherein such adjustment may be made while the saddle is mounted on the horse.

One aspect of this invention relates to an adjustable saddle which includes a pommel (also known in some saddle styles as "swells"). The pommel may be generally arch shaped and may have substantially opposed lower free ends. A seat member is connected to the pommel. A pair of substantially opposed gripping members is attached to the underside of the seat member. The gripping members may each comprise a panel with a forward portion that flexes inwardly to comfortably grip the horse and a rearward position fixed to the underside of the saddle. An adjustment means for flexing the gripping member is provided, preferably at or near each of the lower free ends of the pommel. Each of the adjustment means is adapted to move its corresponding gripping member between a retracted position where the gripping member is adjacent to its corresponding free lower end of the pommel and a gripping position where the gripping member flexes inwardly toward a central longitudinal axis of the saddle. The gripping position is adjustable and provides gripping action against the upper body of a range of horse sizes when the saddle is in use.

Each of the gripping members, which in some styles of adjustable saddle trees are known as "bars," may be formed of flexible material such as a relatively thin sheet of flexible wood or, preferably a plastic such as polyurethane. Each of the adjustment means can impart an inward curvature to each gripping member toward the central horizontal axis of the when the adjustment means is adjusted to flex its corresponding gripping member towards the gripping position.

The rearward ends of the gripping members may be attached to the underside of the seat using screws, staples, bolts, glue or other fastening means which are known to those skilled in the art. In some aspects, the rearward ends of the gripping members are attached to the underside of the seat at a position adjacent the underside of the cantle (rear portion of the seat).

In another aspect, the rearward portion of the gripping member is attached to and lies flat against the underside of the seat while the remaining portion of each gripping member is unattached to the seat and is configured to flex inwardly toward a central elongate horizontal axis of the saddle. Such an arrangement allows the adjustment of the gripping members to impose adjustment forces on the underside of the seat, thereby allowing the panels to constrict and flex into the horse's back. This effectively shapes the underside of the tree to conform to the horse's back and provides a comfortable fit of the saddle to the horse as well as increasing the stability of a rider mounted on the saddle.

The underside of the seat and the rearward ends of the attached gripping members may be at least partially covered by a protective coating such as rawhide or synthetic resinous material to further retain the attached rearward ends of the gripping members in place while allowing the forward portions of the gripping members to flex toward the inward position as urged by the adjustment means. Such synthetic resinous materials are known to those skilled in the art.

The forward portions of the gripping members may be resiliently biased towards the lower ends of the pommel. This may be imparted through the flexibility of the gripping members themselves which, in the normal "unflexed" position, rest against or adjacent to the ends of the pommel. When urged against the bias of the normal unflexed position by the adjustment means, the forward portions of the gripping members move towards the inward position, thereby imparting curvature to the gripping members to grip the body of the horse. It is advantageous for the gripping action to occur against the triceps muscles of the horse and to avoid causing constriction against the shoulder muscles of the horse. The positioning of the gripping members by the adjustment means provides for such positioning of the gripping members against the triceps muscles and is adaptable to horses of different sizes.

In one aspect, the adjustment means comprises a rigid member which distributes the pressure applied by the adjustment means against the gripping member. The rigid member may comprise a plate which engages the gripping member. The adjustment means may also include a second plate attached to the pommel. The two plates may be connected together.

In one aspect, the two plates may be hinged together, preferably along the upper edge of the plates. It is also advantageous to position the hinge substantially parallel with and adjacent to the upper edge of the gripping member. The hinge may comprise a hinge pin or other hinge means. The axis of the hinge defines the axis of curvature of the gripping member such that configuring the hinge will determine the axis of curvature as being essentially transverse to the hinge axis.

In another aspect, the adjustment means may be formed of a pair of plates as described above without a hinging means, wherein the two plates are connected by other means for opening and closing the plates to varying degrees, by means which are known to those skilled in the art.

In some aspects, each of the adjustment means comprise an extendable member which is adapted to pass through an opening in the pommel, thereby making contact directly or indirectly with the forward end of the gripping member. Retracting or extending the extendable member thus has the effect of moving the position of the forward end of the gripping member between the retracted and gripping positions. The extendable member may be a threaded shaft or bolt. The adjustment end of the extendable member is accessed at the opening in the pommel and may be adjusted by means of an adjustment tool such as an Allen key wrench or other equivalent tool known to those skilled in the art.

In the aspect described above where two plates are included in the adjustment means, the first plate (attached to the pommel) may be provided with an internally threaded opening. The extendable member can be threaded through the opening, thereby allowing it to contact the outer surface of the second plate. The action of tightening the bolt moves the bolt inward and forces the second plate (attached to the gripping member) away from the first plate (attached to the pommel end), thereby urging the gripping member toward the inward position. In certain aspects, the extendable member is a bolt configured to provide fine tuning adjustment of the plates wherein a single revolution of the bolt moves the plates together or apart by about ⅛ of an inch at their outer edges.

In some aspects, the extendable member may be provided with a spherical end which engages an indentation in the second plate. This nesting arrangement prevents the inner end of the bolt from slipping against the surface of the second plate.

The adjustable saddle may also include an air bladder system for providing additional fitting and comfort to the body of a horse. The air bladder system may include panels attached to the underside of the seat member, each having an air bladder pocket disposed therewithin. At least two air bladders may be removably contained within the air bladder pockets and each of the air bladders may be provided with an air hose configured to deliver air to its corresponding air bladder. The air hose may be advantageously configured for extension to a position accessible by a seated rider when the saddle is in use.

An advantage is provided by having forward facing adjustment means within reach of a seated rider. The rider is then able to perform adjustments to the saddle using an adjustment tool while seated on the horse. Upon adjustment, the forward ends of the gripping members move inwards to grip the upper body of the horse and the gripping action is also transmitted along the length of the gripping members to the attachment point to the seat member at the rearward end of the gripping members. This configuration removes the need for providing additional rearward adjustment means for the gripping members and provides a convenient and effective method to adjust a saddle for comfort of the rider and the horse, thereby providing significant advantages over adjustable saddles in the prior art which require both forward and rearward adjustments. Proper positioning the gripping members against the triceps muscles of the horse provides a biomechanical advantage, thereby allowing free upper movement of the shoulder and reducing the likelihood of injury of the horse.

BRIEF DESCRIPTION OF THE DRAWINGS

These and other advantages of the invention will become apparent upon reading the following detailed description and upon referring to the drawings in which.

Figure 1A:
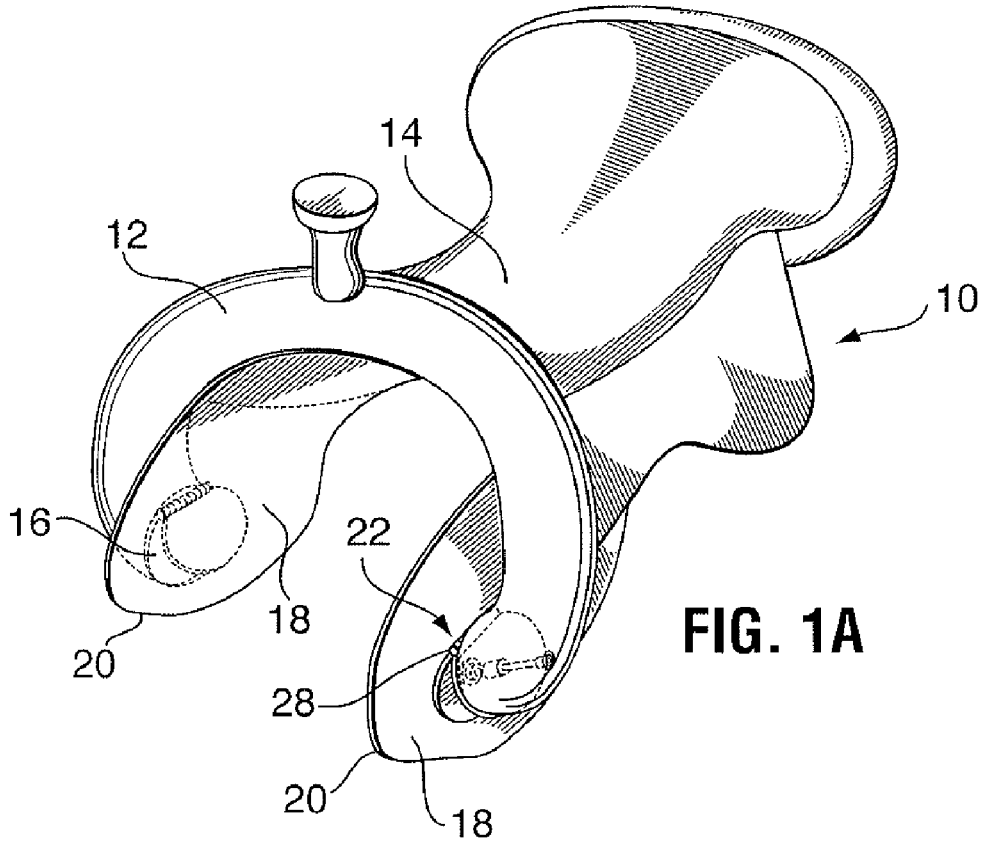
FIG. 1A is a perspective view of the saddle according to one aspect of the invention.

While the invention will be described in conjunction with the illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 1B:
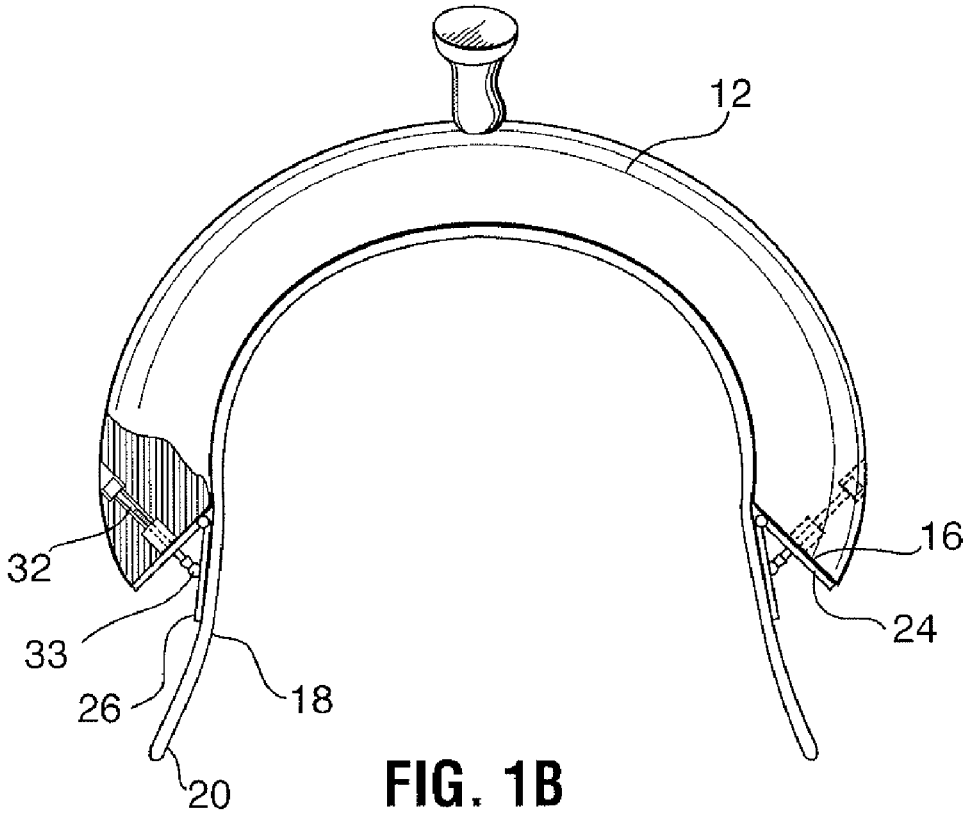
FIG. 1B is a front view of the saddle according to one aspect of the invention.
Figure 2:
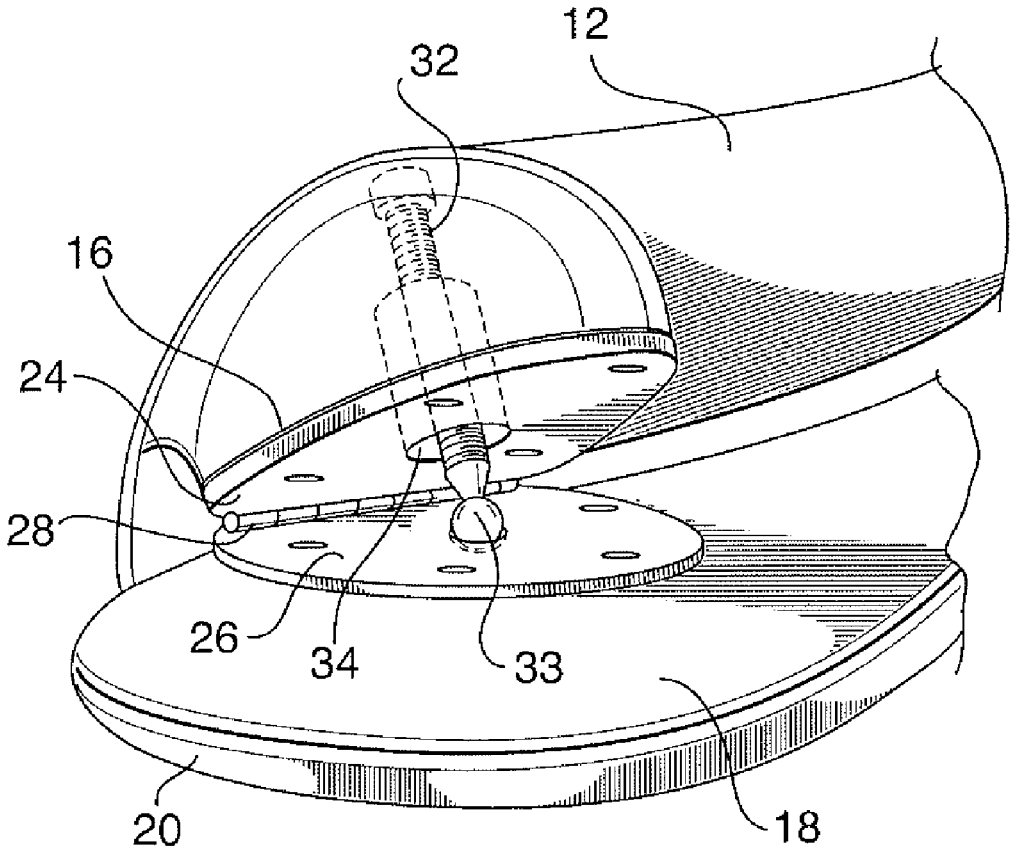
FIG. 2 is a perspective view of the cooperating plates and hinge system showing attachment to the pommel and gripping member according to one aspect of the invention.
Figure 3:
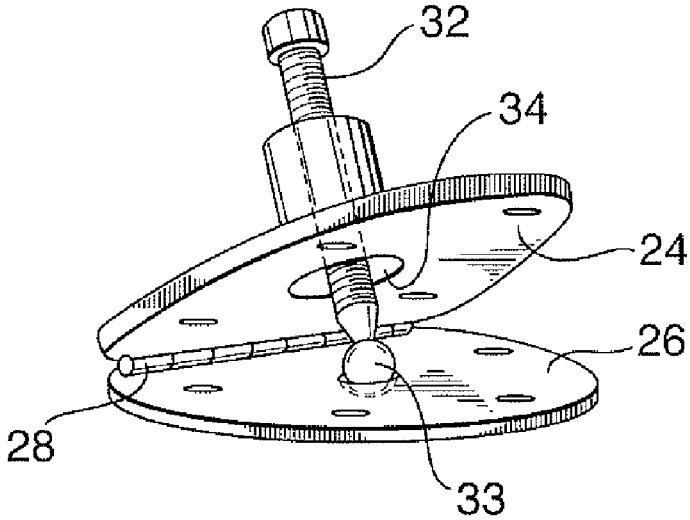
FIG. 3 is a perspective view of the plates and hinge according to one aspect of the invention.
Figure 4:
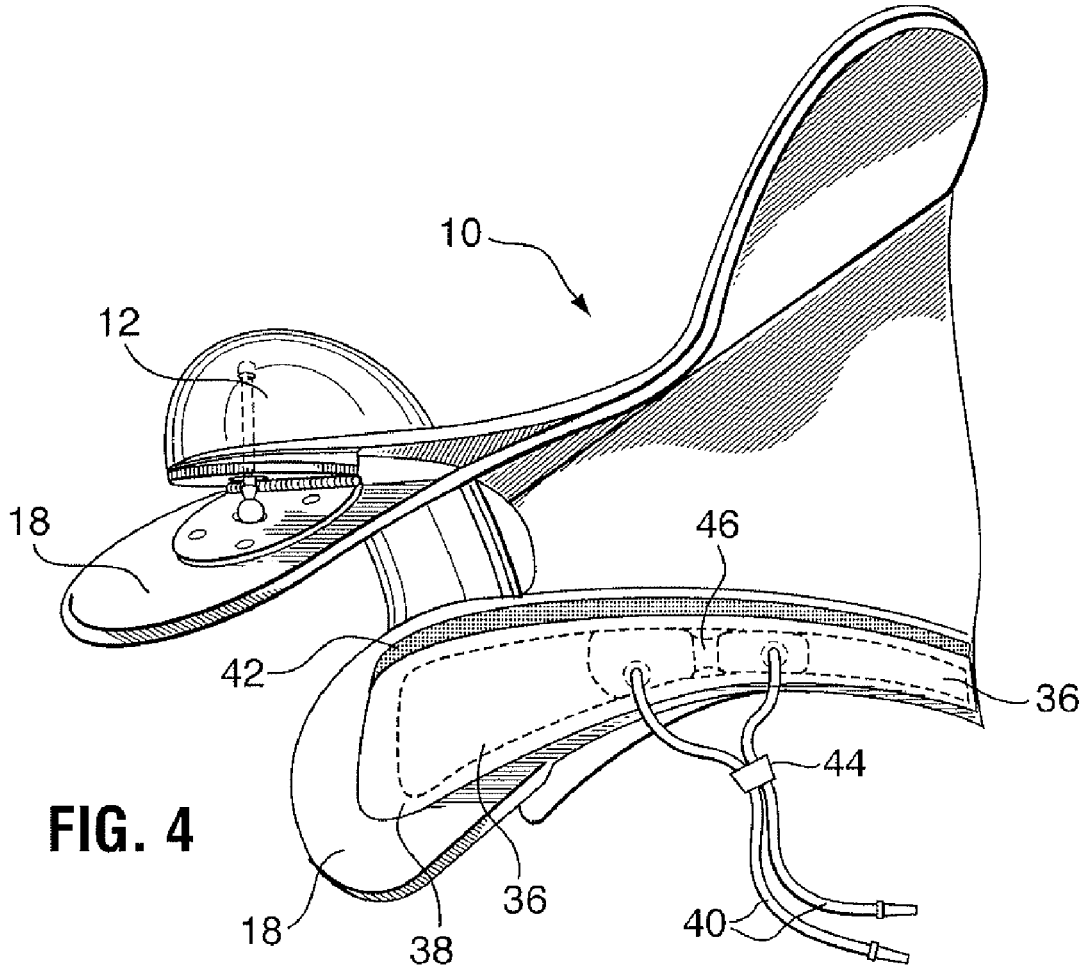
FIG. 4 is a perspective view of the underside of the saddle according to one aspect of the invention.
Figure 5:
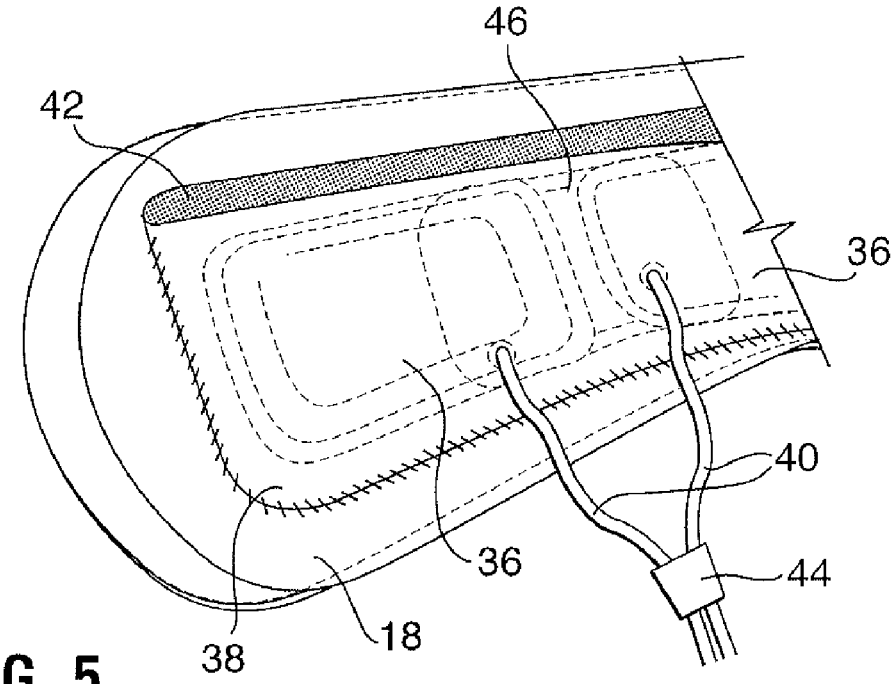
FIG. 5 is a perspective view of the underside of the bar according to one aspect of the invention.
Figure 6:
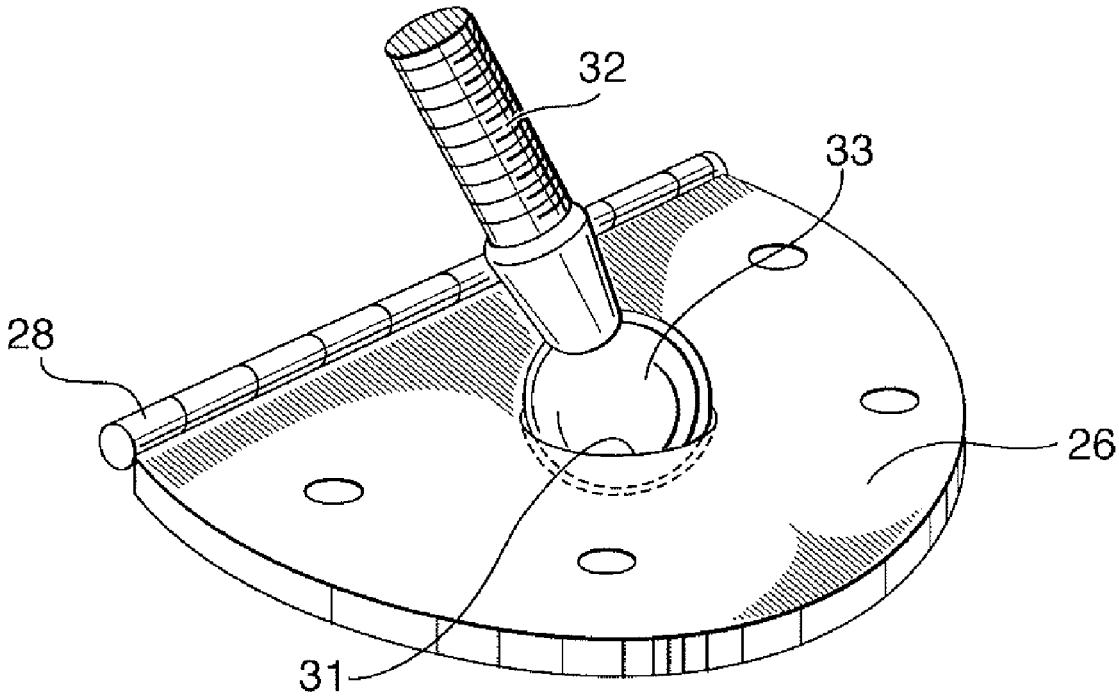
FIG. 6 is a perspective view of the bolt and second plate according to one aspect of the invention.

With reference to FIGS. 1 to 6, in one exemplary aspect, there is provided a saddle 10 which includes a generally arch-shaped pommel 12 to which is connected a seat member 14. The pommel 12 has free substantially opposed ends with generally flat surfaces 16. Gripping members comprising panels 18 extend from intermediate positions on the underside of the seat member 14. Each panel 18 may be attached at one end to the underside of the seat member 14, provided the forward end 20 of each panel 18 is movable towards and away from the corresponding flat surface 16 of the pommel 12. The forward portions 20 of the panels 18 are configured to rest against the triceps of the horse when the saddle is in use.

Each panel 18 is provided with adjustment means 22 disposed between a forward portion 20 and one of the flat surfaces 16 of the pommel 12. The adjustment means 22 is constructed of a pair of plates hinged together and connecting the panel 18 to the pommel surface 16. The plates include a first plate 24 connected to the surface 16 and a second plate 26 connected to the forward portion 20 of the panel 18. A hinge 28 connects the two plates 24, 26 at their upper edges. An extendable member in the form of a bolt 32 is provided which passes through the pommel 12 and through the first plate 24 at a substantially perpendicular angle. Hinge 28 is sufficiently long to impart resistance to internal movement of the attached panel 18. In this fashion, hinge 28 constrains the movement of panel 18, such that it is able to freely flex in an axis transverse to the axis of hinge 28, but resists flexing along other axes.

In this example, the bolt 32 has a spherical end 33 which rests in an indentation 31 in the second plate 26 to increase the surface area of the bolt 32 that encounters the top surface of the second plate 26. When tightened, the bolt 32 moves through an aperture (not shown) in the first plate 24 and comes into contact with the second plate 26. The increased surface area provided by the rounded end 33 of the screw bolt and the indentation 31 of the second plate 26 allow for greater force provided by the bolt 32 to be imparted to the second plate 26 while preventing the bolt 32 from slipping off of the second plate 26.

In this example, the first plate has a recess 34 which surrounds the threaded opening in the first plate 24. The spherical end 33 of the screw bolt 32 is configured to nest within this recess 34 when the second plate 26 is in the closed biased position against the first plate 24. As tightening of the bolt 32 continues, the second plate 26 is forced away from the first plate 24. This action causes the panel 18 which is attached to the second plate 26 to move away from its closed position against the surface 16 of the pommel 12 and towards an inward position on the underside of the seat member 14. In so doing, when the saddle 10 is in use on the body of a horse, the panel 18 tightens the saddle 10 against the body of the horse. The bolt 32 may be any type of bolt known to those with skill in the art such as an Allen bolt of a common standard size which is compatible with an Allen wrench.

In one example, the lateral undersides of the seat member 14 and the panel 18 are fitted with air bladders 36 which have the function of shaping the underside of the saddle 10 to the uneven structure of a horse's body when the saddle 10 is in use. The air bladders 36 rest against the body of the horse and, during adjustment, when the forward portions 20 of the panels 18 move, the air bladders 36 move concurrently. In one aspect, there are two bladders 36 attached to each of the panels 18. The air bladders 36 may be contained within pockets 38 stitched or otherwise attached to the lateral undersides of the seat member 14. The pockets 38 may contain one elongated bladder 36 or two smaller bladders. The bladder 36 may include an air hose 40 having sufficient length to extend from the air bladder 36 to within reach of a rider seated on the saddle. The rider may then conveniently blow air into the bladder 36 to through the hose 40 to adjust the comfort level of the rider in the saddle 10 and the horse. If two air hoses 40 are employed for two separate air bladders 36 on the same side of the saddle 10, the two air hoses 40 may be advantageously equipped with a hose holder 44 for retaining both air hoses 40 in close proximity to each other for convenient access by the rider. If two air bladders 36 are used, they may be connected via an overlapping air bladder 46. The pockets of the panels can be fitted with a fastener 42 such as a Velcro® fastener, for example, so that the air bladders to not fall out of the pockets, while allowing the fasteners to be opened to remove the bladders 36 if necessary.

It will be seen that the present invention has been described by way of preferred embodiments of various aspects of the invention. However, it will be understood that one skilled in the art may readily depart from the embodiments described in detail herein, while still remaining within the scope of the invention as defined in this patent specification as a whole including the claims thereto. If will be further understood that structural or functional equivalents of elements described herein are considered to be within the scope of the invention, as well as departures from any directional references, dimensions or configurations described herein.

What I claim as my invention:

1. An adjustable saddle for a horse or other animal comprising:

a pommel with substantially opposed lower ends, a seat member connected to said pommel;

a pair of substantially opposed gripping members comprising a freely flexible panel configured to contact the flanks of said animal, said panel having a rearward portion affixed to the underside of said seat member and a forward portion having a lower area which is substantially free of contact with said seat member; and an adjustment means connecting said forward portions of said panel to said lower end of said pommel, said adjustment means configured to impart an inward curvature by flexure of the forward portion of said panel thereby providing gripping action against the upper body of said animal wherein said adjustment means comprises a hinge system, said hinge system comprising: a first plate connected to an end of said pommel; and a second plate attached to said forward portion of said panel, said first plate connected to said second plate with a hinge; wherein said hinge is configured to define an axis of flexure of said panel transverse to the axis of said hinge; wherein said hinge system further comprises an extendable member from an external surface of said pommel, said extendable member passing through an opening in said pommel and contacting said second plate, wherein extension of said extendable member permits opening of said plates and retraction of said extendable member permits closure of said plates.

2. The saddle of claim 1 wherein said forward portion of said panel is resiliently biased towards said lower ends of said pommel.

3. The saddle of claim 1 wherein said panel is configured to rest upon the triceps of said animal when said saddle is in use.

4. The saddle of claim 1 wherein each of said pair of substantially opposed gripping members comprises a forward portion and wherein said adjustable saddle comprises two adjustment means each for adjusting said forward portion of said panel of each of said pair of substantially opposed gripping members.

5. The saddle of claim 1 further comprising an air bladder system comprising:

at least two opposed pockets attached to the underside of said seat member, at least two air bladders, each of said air bladders removably contained within said pocket, each of said air bladders comprising an air hose configured to deliver air to said air bladder.

6. The saddle of claim 5 wherein said air hose is configured for extension to a position accessible by a seated rider when said saddle is in use.

7. The saddle of claim 1, wherein the rearward portion of said panel is lying substantially flat against the underside of said seat member.

8. An adjustable saddle for a horse or other animal comprising:

a pommel with substantially opposed lower ends, a seat member connected to said pommel, said seat member having a central axis extending from front to rear corresponding to the front and rear of said animal;

at least one flexible panel comprising a rear portion attached to and directly contacting the underside of said seat member and a forward portion having a lower area free from direct contact with the seat member to permit said lower area of said forward portion to flex inwardly more than said rear portion; and an adjustment means comprising a first plate connected to an end of said pommel, a second plate attached to said lower area of said forward portion of said panel, and a hinge wherein said first plate is connected to said second plate by said hinge, said adjustment means further comprising an extendable member spaced from said hinge and engaged to said plates for maintaining said hinge plates in a predetermined fixed angular relationship, wherein said extendable member is configured to adjust said angular relationship, wherein tightening said extendable member increases the spacing between said lower end of said pommel and said lower area of said panel to impart inward flexing of said lower area of said panel from a retracted position to a gripping position to grip the upper body of said animal, wherein said hinge is configured to define an axis of flexure of said lower area of said panel transverse to the rotational axis of said hinge.

9. The saddle of claim 8, wherein the rearward portion of said panel is lying substantially flat against the underside of said seat member.

10. The saddle of claim 8, wherein tightening of said extendable member causes said lower area of said forward portion of said panel to flex inwardly toward said central axis.

11. The saddle of claim 8, wherein said forward portion of said panel is resiliently biased towards said lower ends of said pommel.

12. The saddle of claim 8, wherein said extendable member passes through an opening in said pommel and contacts said second plate, wherein extension of said extendable member causes opening of said plates to cause said panel to inwardly flex to a gripping position.

13. The saddle of claim 8, wherein the rearward portion of said panel is lying substantially flat against the underside of said seat member.

14. The saddle of claim 8, wherein tightening of said extendable member causes said lower area of said forward portion of said panel to flex inwardly toward said central axis.

15. The saddle of claim 8, wherein said forward portion of said panel is resiliently biased towards said lower ends of said pommel.

* * * * *